United States Patent [19]

Helling et al.

[11] 4,388,403

[45] Jun. 14, 1983

[54] PROCESS FOR THE PREPARATION OF DISPERSIONS OF HYDROPHOBIC SUBSTANCES IN WATER

[75] Inventors: Günter Helling, Odenthal; Helmut Reiff; Wolfgang Himmelmann, both of Leverkusen; Günter Renner, Gladbach, all of Fed. Rep. of Germany

[73] Assignee: Agfa-Gevaert Aktiengesellschaft, Leverkusen, Fed. Rep. of Germany

[21] Appl. No.: 305,201

[22] Filed: Sep. 24, 1981

[30] Foreign Application Priority Data

Sep. 30, 1980 [DE] Fed. Rep. of Germany ..... 3036846

[51] Int. Cl.[3] ..... G03C 1/40

[52] U.S. Cl. ..... 430/546; 430/377; 430/635; 430/636; 430/637; 524/87; 524/106; 524/110; 524/113; 524/169; 524/171; 524/218

[58] Field of Search ..... 430/449, 546, 377, 635, 430/636, 637, 374; 524/87, 106, 110, 113, 169, 171, 218

[56] References Cited

U.S. PATENT DOCUMENTS

| | | | |
|---|---|---|---|
| 3,619,195 | 11/1971 | Van Campen | 430/546 |
| 3,658,546 | 4/1972 | Van Doorselaer et al. | 430/546 |
| 3,788,857 | 1/1974 | Van Poucke et al. | 430/546 |
| 4,198,478 | 4/1980 | Yoneyama et al. | 430/449 |
| 4,247,627 | 1/1981 | Chen | 430/510 |

*Primary Examiner*—J. Travis Brown

*Attorney, Agent, or Firm*—Connolly and Hutz

[57] ABSTRACT

Dispersions of hydrophobic substances in water are prepared by dissolving the hydrophobic substance together with an ionomeric polyaddition or condensation product in an organic, water-miscible solvent or a mixture of such a solvent with water, diluting the solution with water and removing the organic solvent. The dispersions are excellently suitable for the preparation of photographic recording materials.

7 Claims, No Drawings

PROCESS FOR THE PREPARATION OF DISPERSIONS OF HYDROPHOBIC SUBSTANCES IN WATER

This invention relates to a process for the preparation of dispersions of hydrophobic substances by means of ionomeric polyaddition and/or polycondensation products and to the use of such dispersions for the preparation of light-sensitive recording layers.

It is known to use polymers as protective colloids for the preparation of dispersions containing hydrophobic substances. In U.S. Pat. No. 2,272,191 there is described a process for the preparation of color photographic layers wherein a solution of polystyrene and a polymer selected from polyvinyl acetal, polyvinyl acetate and coumarone indene in an organic solvent is mixed with a color component and the mixture is incorporated in a silver halide emulsion. These dispersions have the disadvantages not only that the preparation thereof requires the use of dispersion apparatus consuming a large amount of energy, but also that they have little stability in storage.

The polyurethane latices charged with hydrophobic compounds, known from the European Patent Application 0014 921, are prepared by charging the finished polymer dispersion, the particle size of which has therefore already been fixed. The disadvantage of this method of procedure is that the particles are increased in size during the charging process. Therefore dispersions are obtained which are more coarsely grained than the starting dispersions which therefore tend to undergo sedimentation and which may cloud the photographic layers.

According to German Offenlegungsschrift No. 1,812,578, color couplers are dissolved in an emulsion copolymer of styrene/butadiene, acrylonitrile/butadiene or vinyl chloride/vinylidene chloride and the resulting solution is added to a photographic emulsion. German Offenlegungsschrift No. 2,541,230 relates to a process for charging polymer particles obtained in the form of a polymer latex with hydrophobic substances by mixing the latex with a solution of the hydrophobic substance in a water-miscible solvent. In a method described in German Auslegeschrift No. 2,541,274, synthetic latices are charged with a hydrophobic substance by adding an aqueous latex to a solution of the hydrophobic substance in a water-miscible organic solvent or solvent mixture and then removing the organic solvent or solvent mixture from the latex. The preparation of a latex charged with a hydrophobic substance by mixing the latex with the substance which is dissolved in a water-miscible organic solvent has been described in German Offenlegungsschrift No. 2,835,856. Common to all these processes is that the hydrophobic substances are introduced into an aqueous polymer dispersion. One disadvantage of this procedure is that the resulting charged or impregnated dispersions lose stability due to the hydrophobic substances with which they are charged, and consequently sediment and form agglomerates while they are being charged or subsequently. The possibilities of using these dispersions are thereby considerably restricted. For example, the dispersions cannot be used in the transparent layers commonly employed for reproduction work because they cause cloudiness in the layers.

German Offenlegungsschrift No. 1,597,467, discloses a photographic material in which an anionic polyurethane containing a water-insoluble optical brightening agent is present in one or more of the gelatine layers thereof. The quantity of optical brightener which may be introduced into the gelatine layer by means of the polyurethane is, however, limited to 5%, by weight, at the most.

In a process described in DD Patent No. 138,831, polyurethanes dissolved in mixtures of high boiling and low boiling solvents are used for the introduction of photographic additives into photographic casting solutions. One disadvantage of this method is that the photographic layers obtained carry an additional load of high boiling solvents. This ballast of high boiling solvents prevents the formation of thin layers such as are required for the production of very sharp images. Additionally, the precipitation dispersion process employed here requires the use of considerable quantities of auxiliary solvents if fine grained dispersions are to be obtained, as described in Angew. Makromol. Chem., 72 (1978) pages 115 et seq. This considerably limits the economic viability of the process.

It is an object of the present invention to develop a process for the production of stable, fine grained dispersions of hydrophobic substances in water with as little technical expenditure as possible.

The present invention relates to a process for the preparation of dispersions of hydrophobic substances in water by the charging of an ionically modified polymer with the hydrophobic substance, characterised in that the hydrophobic substance is dissolved together with an ionomeric polyaddition or condensation product in an organic, water-miscible solvent having a boiling point below 120° C. or a mixture of the organic solvent with water in proportions, by weight, of from 50:50 to 100:0, preferably from 75:25 to 95:5, water is added to the solution so that a solvent/water mixture in proportions, by weight, of from 10:1 to 1:10 is obtained, and the organic solvent is then removed.

The ionomeric polyaddition or polycondensation products used according to the present invention contain from 4 to 180 milli-equivalents per 100 g of ionic groups or of groups capable of conversion into ionic groups and/or from 1 to 20% by weight, of alkylene oxide units of the formula: $—CH_2—CH_2—O—$ built into a polyether chain which may be a side chain or form part of the main chain.

The ionomeric polyaddition and polycondensation products which may be used according to the present invention, hereinafter referred to as "ionomeric products", include polyurethanes, polyesters, polyamides, polyureas, polycarbonates, polyacetals and polyethers, as well as other ionomeric products each belonging to two or more types of polymers, e.g. polyester polyurethanes, polyether polyurethanes or polyester ureas, which contain from 4 to 100 milliequivalents per 100 g of ionic groups or of groups capable of conversions into ionic groups and/or from 1 to 20%, by weight, of ethylene oxide units of the formula: $CH_2CH_2—O—$ built into a polyethylene chain, the polyether chain being in a side chain or forming part of the main chain.

Ionomeric products of the type used according to the present invention are known and have been described, e.g. in Angewandte makromolekulare Chemie, 26 (1972), pages 45 to 106; Angewandte Chemie 82 (1970), pages 53 et seq, and J. Oil. Col. Chem. Assoc. 53 (1970), page 363. Further descriptions of suitable ionomeric products may be found in German Offenlegungsschrift Nos. 2,637,690; 2,642,973; 2,651,505; 2,651,506;

2,659,617; 2,729,245; 2,730,514; 2,732,131; 2,734,576 and 2,811,148.

Ionomeric products containing anionic groups are preferred. Ionomeric products which are particularly suitable for the process according to the present invention have been described in German Patent No. 1,472,746. These ionomeric products are based on polyurethanes obtained from compounds having molecular weights of from 300 to 10,000 containing several reactive hydrogen atoms, polyisocyanates and optionally chain-lengthening agents containing reactive hydrogen atoms. During or after the preparation of these polyurethanes, any isocyanate groups still present in them are reacted with a compound containing at least one active hydrogen atom and at least one salt group or group capable of salt formation. If compounds containing groups capable of salt formation are used, the resulting anionic polyurethanes are subsequently at least partially converted into the salt form in known manner.

By "salt group" are meant the following groups: $-SO_3^-$, $-COO^-$; the quantities used being from 4 to 180 milliequivalents per 100 g of ionic groups or of groups capable of conversion into ionic groups.

The compounds described below are examples of suitable starting components for the preparation of the anionic polyurethanes.

I

Compounds containing active hydrogen atoms

These compounds are substantially linear and have a molecular weight of from ca. 300 to 10,000, preferably from 500 to 4000. These known compounds have hydroxyl and amino end groups. Polyhydroxyl compounds, such as polyesters, polyacetals, polyethers, polyamides and polyester amides are preferred. The hydroxyl number of these compounds is therefore approximately from 370 to 10, in particular from 225 to 28.

Suitable polyethers include e.g. the polymerisation products of ethylene oxide, propylene oxide, tetrahydrofuran and butylene oxide and copolymers and graft polymers thereof, the condensates obtained by the condensation of polyhydric alcohols or mixtures thereof, and the products obtained by alkoxylation of polyhydric acohols.

Suitable polyacetals include, e.g. compounds obtainable from hexane diol and formaldehyde. Suitable polyesters, polyester amides and polyamides include the predominantly linear condensates obtained from polybasic saturated carboxylic acids and polyfunctional saturated alcohols, aminoalcohols, diamines and mixtures thereof.

Polyhydroxyl compounds already containing urethane or urea groups and modified or unmodified natural polyols, such as castor oil, or carbohydrates may also be used.

Various mixtures of polyhydroxyl compounds may, of course, also be used in order to vary the lyophilic or hydrophobic character and mechanical properties of the end products.

II

Polyisocyanates

Suitable polyisocyanates include all aromatic and aliphatic diisocyanates, e.g. 1,5-naphthylene diisocyanate, 4,4'-diphenylmethane diisocyanate, 4,4'-diphenyldimethylmethane diisocyanate, di- and tetra-alkyldiphenylmethane diisocyanate, 4,4'-dibenzyl diisocyanate, 1,3-phenylene diisocyanate, 1,4-phenylene diisocyanate, the isomers of tolyene diisocyanate, optionally as mixtures, and preferably aliphatic diisocyanates, butane-1,4-diisocyanate, hexane-1,6-diisocyanate, dicyclohexylmethane diisocyanate, cyclohexane-1,4-diisocyanate and isophorone diisocyanate.

III

Chain-lengthening agents

The following are chain-lengthening agents with reactive hydrogen atoms:

1. The conventional glycols, such as ethylene glycol or condensates of ethylene glycol, butane diol, propane diol-(1,2),propane diol-(1,3), neopentyl glycol, hexane diol, bis-hydroxymethyl-cyclohexane and dioxyethyldiane;

2. Aliphatic, cycloaliphatic and aromatic diamines, such as ethylene diamine, hexamethylene diamine, 1,4-cyclohexylene diamine, benzidine, diaminodiphenylmethane, the phenylene diamine isomers, hydrazine and ammonia;

3. Amino alcohols, such as ethanolamine, propanolamine and butanolamine;

4. Polyfunctional amines or hydroxyl compounds, such as diethylene triamine, triethylene tetramine, tetraethylene pentamine, pentaethylene hexamine, hexaethylene heptamine, glycerol, erythritol, 1,3-diaminoisopropanol, 1,2-diaminopropanol, the monooxalkylated polyamines, such as N-oxethyl-ethylenediamine, N-oxethylhydrazine and N-oxethylhexamethylenediamine;

5. Water.

IV

Compounds capable of salt formation

1. Compounds containing fully developed acid groups (a) Hydroxy acids, such as glyceric acid, lactic acid, trichlorolactic acid, malic acid, dihydroxymaleic acid, dihydroxyfumaric acid, tartaric acid, dihydroxytartaric acid, citric acid, dimethylolpropionic acid and dimethylolbutyric acid, aliphatic, cycloaliphatic aromatic and heterocyclic mono- and di-aminocarboxylic acids, such as glycine, $\alpha$- and $\beta$-alanine, 6-aminocaproic acid, 4-aminobutyric acid, the isomeric mono- and diaminobenzoic acids and the isomeric mono- and diaminonaphthoic acids;

(b) Hydroxy and carboxysulphonic acids; 2-hydroxyethane sulfonic acid, phenosulfonic acid-(2), phenosulfonic acid-(3), phenosulfonic acid-(4), phenoldisulfonic acid-(2,4), sulfoacetic acid, m-sulfobenzoic acid, p-sulfobenzoic acid, benzoic acid-(1)-disulfonic acid-(3,5), 2-chlorobenzoic acid-(1)-sulfonic acid-(4), 2-hydroxybenzoic-(1)-sulfonic acid-(5), naphthol-(1)-sulfonic acid, naphthol-(1)-disulfonic acid, 8-chloronaphthol-(1)-disulfonic acid, naphthol-(1)-trisulfonic acid, naphthol-(2)-sulfonic acid-(1) and naphthol-(2)-trisulfonic acid;

(c) Aminosulfonic acids; amidosulfonic acid, hydroxylamine monosulfonic acid, hydrazine disulfonic acid, sulfanilic acid, N-phenylamino-methane sulfonic acid, 4,6-dichloroaniline-sulfonic acid-(2), phenylene diamine-(1,3)-disulfonic acid-(4,6), naphthylamine-(1)-sulfonic acid, naphthylamine-(2)-sulfonic acid, naphthylamine-disulfonic acid, naphthylamine-trisulfonic acid, 4,4'-di-(p-aminobenzoylamino)-diphenylurea-disulfonic acid-(3,3'), phenylhydrazine-disulfonic acid-(2,5), taurine, methyltaurine, butyl taurine, 3-benzoic acid-(1)- sulfonic acid-(5), 3-aminotoluene-N-methane sulfonic acid, 4,6-diaminobenzene- disulfonic acid-(1,3), 2,4-diaminotoluene-sulfonic aicd-(5), 4,4'-diamnodiphenyl-disulfonic acid-(2,2'), 2-aminophenol-sulfonic acid-(4), 4,4'-diamino-diphenyl-ether- sulfonic acid-(2), 2-aminoanisole-N-methane sulfonic acid, 2-amino-diphenylamine sulfonic acid, ethylene glycol sulfonic acid, 2,4-diaminobenzene sulfonic and N-sulfonatoethylethylene diamine;

(d) also included among the hydroxy and aminocarboxylic and sulfonic acids and polycarboxylic and sulfonic acids are the (optionally saponified) addition products of unsaturated acids, such as acrylic, methacrylic, vinylsulfonic and styrene sulfonic acid, and unsaturated nitriles, such as acrylonitrile, of cyclic dicarboxylic acid anhydrides, such as maleic, phthalic or succinic acid anhydride, of sulfocarboxylic acid anhydrides, such as sulfoacetic or o-sulfobenzoic acid anhydride and of lactones, such as $\beta$-propiolactone or $\gamma$-butyro-lactone, the addition products of the reaction products of olefins with sulfur trioxide, such as carbyl sulfate, of epoxycarboxylic and epoxysulfonic acids, such as glycidic acid or 2,3-epoxypropane sulfonic acid, of sultones, such as 1,3-propane sultone, 1.4-butane sultone or 1,8-naphthylsultone, of cyclic sulfates, such as glycol sulfate or of disulfonic acid anhydrides, such as benzene disulfonic acid-(1,2)-anhydride, with aliphatic and aromatic amines, such as 1,2-ethylene diamine, 1,6-hexamethylene diamine, the isomeric phenylene diamines, diethylene triamine, triethylene triamine and tetraethylene pentamine, and the addition products of sodium hydrogen sulfite with olefinically unsaturated compounds, such as allyl alcohol, maleic acid and maleic acid-bis-ethylene- and bis-propylene glycol ester;

(e) Hydrazine carboxylic acids, such as hydrazine dicarboxylic acids. 2. Reactive compounds having from 3 to 7 ring members containing salt groups or groups which are capable of salt formation after ring opening:

(a) Dicarboxylic acid anhydrides, such as succinic acid anhydride, maleic acid anhydride and (optionally hydrogenated) phthalic acid anhydride;

(b) Tetracarboxylic acid dianhydrides, such as 1,2,4,5-benzene-tetracarboxylic acid dianhydride;

(c) disulphonic acid anhydrides, such as benzene disulfonic acid-(1,2)-anhydride;

(d) sulfocarboxylic acid anhydrides, such as sulfoacetic acid anhydride and o-sulfobenzoic acid anhydride;

(e) sultones, such as 1,3-propane sultone, 1,4-butane sultone and 1,8-naphthosultone;

(f) lactones, such as $\beta$-propiolactone and $\gamma$-butyrolactone;

(g) epoxycarboxylic acids, such as glycidic acid, optionally in the form of alkali metal salts thereof;

(h) epoxy sulfonic acids, such as 2,3-epoxypropane sulfonic acid-1, optionally in the form of the alkali metal salts thereof, and the addition products of epoxy aldehydes and alkali metal bisulfites e.g. the bisulfite compound of glycidyl aldehyde.

The acid groups mentioned above may be converted into the salt form in the conventional manner by reaction with the compounds mentioned below:

Inorganic bases, compounds which are basic in reaction or which split off bases, such as monovalent metal hydroxides, carbonates and oxides, e.g. sodium hydroxide, potassium hydroxide, sodium carbonate, potassium carbonate and sodium bicarbonate; also organic bases, such as tert.amines, e.g. trimethylamine, triethylamine, dimethylaminoethanol, dimethylaminopropanol, ammonia and the like.

The quantity of polyisocyanates is preferably chosen so that all the isocyanate reactive groups undergo reaction.

The reaction may be carried out with the aid of solvents, which should be low boiling solvents having boiling points below 120° C., such as acetone, ethanol, methanol, tert.-butanol, methyl ethyl ketone, acetonitrile, tetrahydrofuran or dioxane, optionally containing a proportion of water. The solvent used for inorganic bases and for compounds having at least one isocyanate-reactive hydrogen atom and at least one salt group or group capable of salt formation may be water, optionally without the addition of organic solvents.

The predominantly linear high molecular weight anionic polyurethanes are generally obtained in the form of clear to slightly opalescent solutions in the above-mentioned polar solvents. The solids content thereof is from *ca.* 5 to 50%, by weight, of ionic polyurethane.

The method of preparation of the ionomeric products used according to the present invention will now be described with the aid of the following Examples.

Polymer I

An isocyanate prepolymer (1.78% NCO) is prepared from 800 g (0.356 mol) of a polyester of adipic acid and 1,4-butane diol (dehydrated) and 95 g (0.546 mol) of 2,4-tolyene diisocyanate by reaction at from 75 to 85° C. for 1.5 hours. The prepolymer is dissolved hot in 1060 g of tetrahydrofuran and to it is added a solution of 53 g (0.13 mol) of an aqueous solution of the sodium salt of N-sulfonatoethyl-ethylene diamine in 100 ml of water at 50° C. A further 500 g of tetrahydrofuran is added after 5 minutes owing to the sharp rise in viscosity. A clear polyurethane-polyurea solution having the following characteristic data is obtained:

| | |
|---|---|
| Solids content: | 35.3% |
| Viscosity (24° C.): | 1000 cp |
| Viscosity (24° C.) of a sample of the solution adjusted to 30% using tetrahydrofuran: | 400 cp |
| sulfonate group content: | 40.1 m equivalent/100 g. |

Polymer II

The procedure is the same as that described for Polymer I, but using acetone as solvent instead of tetrahydrofuran. A clear polyurethane-polyurea solution having a solids content of 43.6% and a viscosity of 5700 cp (24° C.) is obtained using 1060 g of acetone and 42.5 g (0.104 mol) of an aqueous solution of the sodium salt of N-sulfonatoethyl-ethylene diamine. A solution adjusted to a solids content of 30% has a viscosity of 300 cp (24° C.). The sulfonate group content is 14.1 m equvialent/100 g.

Polymer III

An isocyanate prepolymer (NCO=1.68%) is prepared as described for polymer I from 400 g (0.178 mol) of a polyester of adipic acid and 1,4-butane diol (dehydrated) and 47.5 g (0.273 mol) of tolyene diisocyanate (isomeric mixture 65:35). The prepolymer is dissolved hot in 980 g of acetone, and an aqueous solution of 42.5 g (0.104 mol) of the sodium salt of N-sulfonatoethylethylenediamine and 75 ml of water is added at 50° C. A slightly yellowish solution of a polyurethane urea is obtained.

| | |
|---|---|
| Solids content: | 30.0% |
| Viscosity (23° C.) | 2200 cp |
| Sulfonate group content: | 22.2 m equivalent/100 g. |

Polymer IV

An isocyanate prepolymer (4.11% NCO) is prepared from 550 g (1.0 mol) of a polyether based on bisphenol-A and propylene oxide and 140 g (0.08 mol) of a polyester of phthalic acid, adipic acid and ethylene glycol (all dehydrated) and 145 g (0.239 mol) of a 70% solution of a propoxylated adduct of butylene diol and sodium bisulfate in toluene and 315 g (1.875 mol) of 1,6-diisocyanatohexane by reacting the substances for 6.5 hours at 100° C. 77 g (1.283 mol) of urea are added and the mixture is briefly heated to 135° C. and stirred at 130° C. until no isocyanate may be detected in the IR spectrum. 290 ml of water, followed by 1582 g of acetone are then added with cooling. A clear, slightly yellowish solution of a polyurethane-polyurea in acetone is obtained.

| | |
|---|---|
| Solids content: | 40% |
| Viscosity (23° C.) | 60 cp |
| Sulfonate group content: | 19 m equivalent/100 g |

Polymer V 2200 g (4.0 mol) of a polyether based on bisphenol-A and propylene oxide and 115 g (0.053 mol) of a monofunctional polyether of n-butanol, propylene oxide and ethylene oxide are dehydrated and 160 g (0.113 mol) of a 70% solution in toluene of the sodium salt of polymer IV described above are added. 1096 g (6.30 mol) of tolyene diisocyanate (80:20 isomeric mixture inactivated with 20 mg of hydrogen chloride) are added at 60° C. The temperature rises to 60° C. in spite of cooling. Stirring is continued for 5 hours at 80° C. (NCO=4.95%), the solids content is adjusted to 70% using acetone and the mixture is reacted with 152 g (1.350 mol) of acetone ketazine.

733 ml of acetone and 95 ml of water are added to 900 g of the solution described above and the mixture is stirred overnight at room temperature. A clear polyurethane-polyurea solution is obtained.

| | |
|---|---|
| Solids content: | 36.5% |
| Viscosity: | 19000 cp |
| Sulfonate group content: | 7.5 m equivalent/100 g |

A solution diluted to a solids content of 30% using acetone has a viscosity of 3000 cp.

Examples of hydrophobic substances which may be treated in the manner according to the present invention include hydrophobic UV absorbents, filter dyes, color couplers, sensitizers, color developer compounds, silver halide developer compounds, compounds capable of splitting off or releasing hydrophobic dyes, optical brighteners, antioxidants, silver halide solvents, compounds which may be hardened by irradiation, photoinitiaters or mixtures of such substances.

Suitable water-miscible organic solvents for the process according to the present invention are those capable of solving both the ionomeric products and the hydrophobic substances. Examples of such solvents include acetone, tetrahydrofuran, dioxane, isopropanol, methanol, ethanol, methyl ethyl ketone and acetonitrile.

The quantities of hydrophobic substances used for the process according to the present invention generally amount to from 2 to 200%, by weight, of hydrophobic substance per 100%, by weight, of ionomeric product. The proportions of hydrophobic substance to ionomeric product are preferably from 1:20 to 1:1, by weight.

To prepare the dispersions, water is run into a solution of the water-insoluble hydrophobic substance and ionomeric product in a water-miscible low boiling solvent or solvent/water mixture with stirring. The solvent is removed from the resulting dispersion by distillation or other suitable method of separation, such as dialysis or ultrafiltration.

The process according to the present invention is eminently suitable for the incorporation of color couplers in color photographic recording materials. Silver halide emulsions to which the dispersions containing color couplers have been added may advantageously be cast to form thin color photographic layers in which the color couplers are capable of reacting with oxidized color developer compounds, e.g. compounds consisting of primary aromatic amines, to form dyes. Examples of color couplers capable of being incorporated in photographic recording layers by the process according to the present invention include compounds from the group compising β-dicarbonyl compounds, β-ketoacetonitriles, 5-pyrazolones, pyrazolobenzimidazoles, indazolones, phenols and napthols. Such couplers are known in the literature and have been described for example in James, "The Theory of the Photographic Process", Chapter 12, pages 335 et seq. Relevant information may also be found in the publications mentioned in Research Disclosure VII, 1978 under the reference number 17 643.

The following hydrophobic color couplers are particularly suitable for incorporation in colour photographic layers by the process according to the present invention.

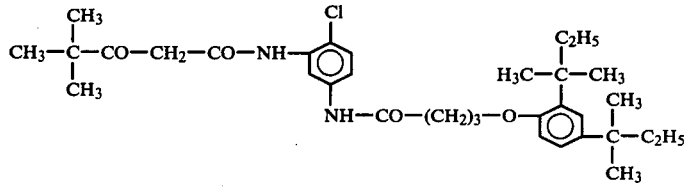

Y1

-continued
Y2
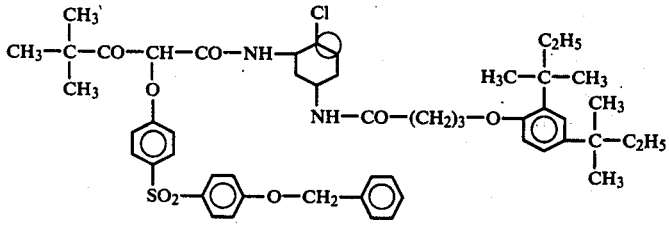
Y3
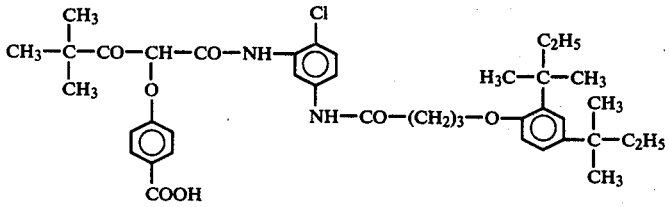
Y4
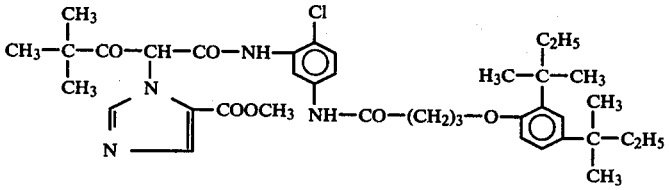
Y5
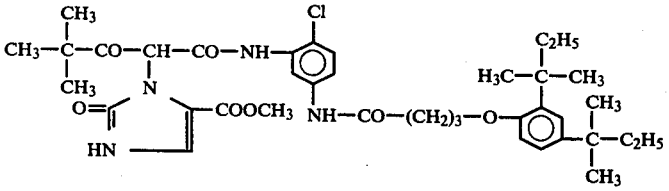
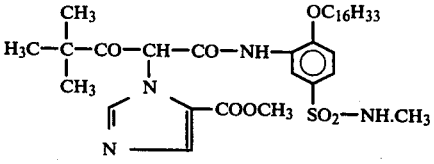
Y6
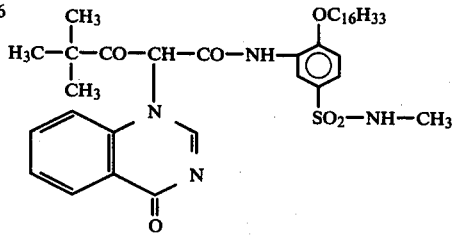
Y7
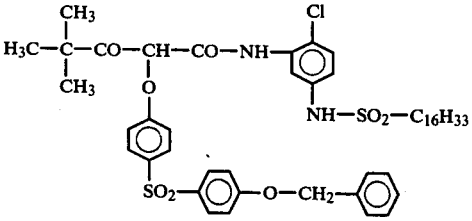
Y8
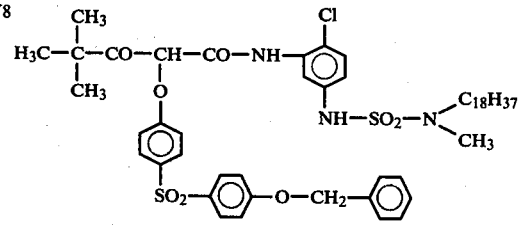
Y9
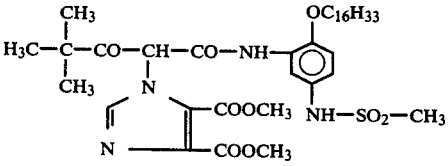
Y10
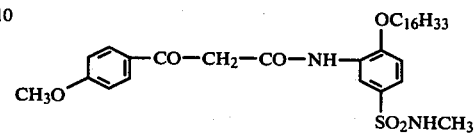
Y11

-continued
Y12
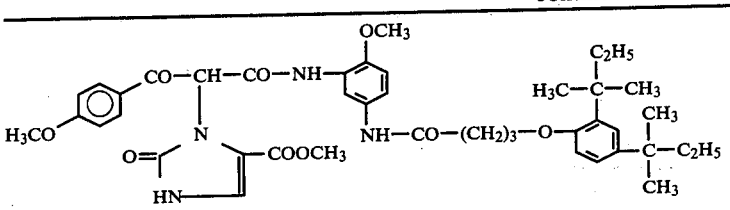
Y13
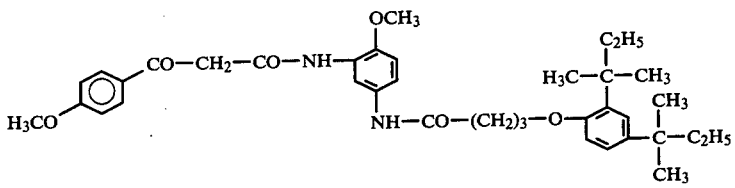
Y14
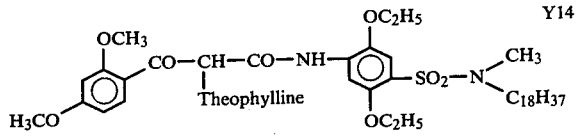
Y15
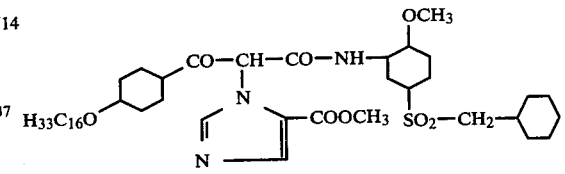
Magenta coupler:
M1
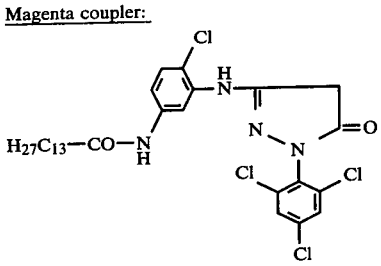
M2
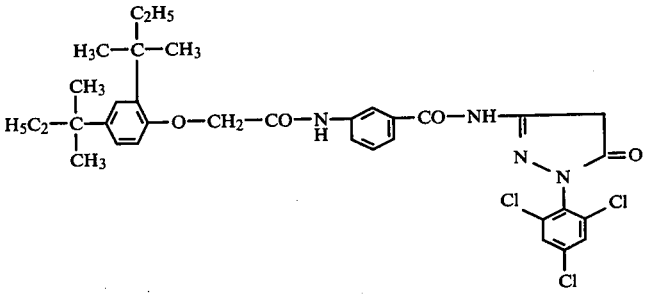
M3
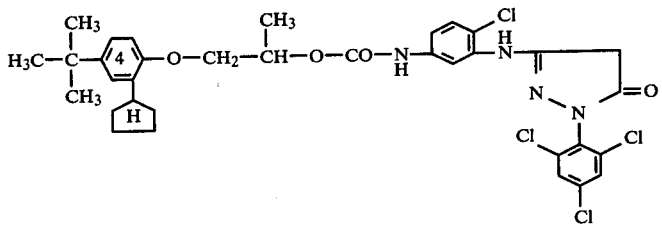
M4
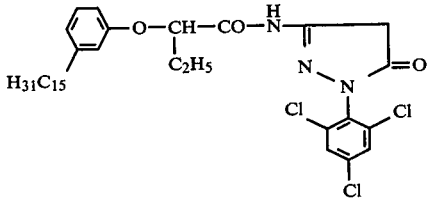
Cyan coupler:

-continued

C1

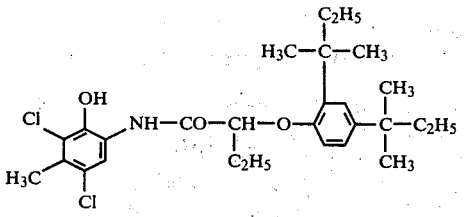

C2

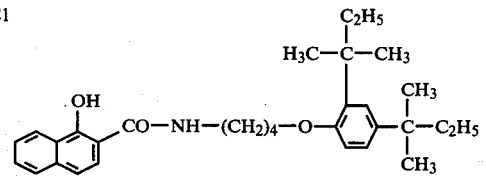

C3

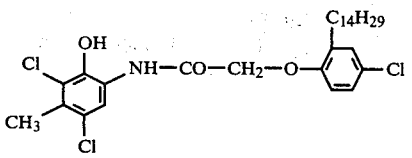

C4

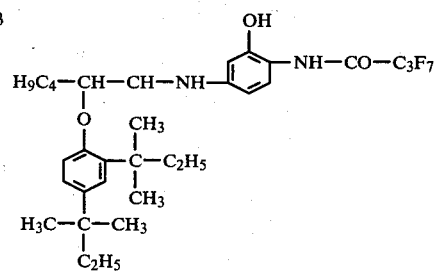

The process according to the present invention enables stable dispersions of hydrophobic substances in water to be obtained without the aid of wetting agents and high energy consuming dispersing apparatus. The dispersions are found to have a surprisingly high resistance to sedimentation and are therefore eminently suitable for storage, a chacteristic which is a considerable advantage, e.g. for the process of producing recording layers. Added to this is the advantage that image dyes of color photographic recording materials containing dispersions which have been prepared by the process according to the present invention have substantially improved resistance to light. By virture to the absence of wetting agents and high boiling solvents in the dispersions according to the present invention, moreover, the binder content of color photographic recording layers may be kept low since the dispersions are stable without the aid of protective colloids, such as gelatine.

The process of the invention differs from known processes for the preparation of aqueous dispersions of hydrophobic substances in particular in that advantageously, the starting material does not consist of polymer dispersions, but of solutions of the ionomeric products described above, from which the particles containing the hydrophobic substances are newly formed. The charged particles obtained from such solutions are smaller than the particles formed according to known processes by charging polymer dispersions. The use of the dispersions prepared by the process of the invention is accordingly associated with a number of advantages: The dispersions are able to be stored without risk of sedimentation, they do not cause clouding of the photographic layers and in the photographic layer assembly the incorporated hydrophobic substances are more readily accessible for chemical reactions, because of the large surface area of the particles.

The invention will now be explained in more detail with the aid of the following Examples, in which percentages denote percentages, by weight, unless otherwise indicated.

The following color coupler dispersions were prepared:

DISPERSION 1

100 g of a 30% solution of polymer I in a mixture of 90 parts of tetrahydrofuran and 10 parts of water were stirred together with a solution of 15 g of coupler Y 6 in 62 g of tetrahydrofuran to form a clear solution. 173 g of water were then added at a rate of 20 g per minute and the tetrahydrofuran was evaporated off under vacuum. The dispersion prepared in this manner has a solids content of 21% and an average particle size of 180 nm. The dispersion remained resistant to sedimentation even after it had been left to stand for a considerable time (100 days). When mixtures of the dispersion with gelatine were cast on a glass plate and dried, completely transparent layers were obtained.

DISPERSION 1a

This dispersion is prepared by stirring a solution of polyurethane and coupler into water and evaporating off the solvent, using a method based on that described in DD Patent No. 138,831, which is a process of precipitation dispersion, while in the process according to the present invention water is added to a solution of polyurethane and coupler, and the solvent is evaporated off. In that case, the dispersion is formed by phase reversal (see dispersion 1).

To prepare the comparison dispersion, 50 g of a 30% solution of polymer I in a mixture of 90 parts of tetrahydrofuran and 10 parts of water are stirred together with a solution of 7.5 g of coupler Y 6 in 31 g of tetrahydrofuran to form a clear solution. The resulting solution is added to 86.5 g of water with stirring. The tetrahydrofuran is then removed by distillation.

The comparison provides the following results:

| | Precipitation dispersion DD Patent No. 138,831 | Dispersion according to the present invention by phase reversal |
|---|---|---|
| Particle size | >500 nm | 180 nm |
| Residue | 5.7% | 0% |
| Layers containing gelatine | matt | transparent |

This shows that the method of precipitation dispersion is unsuitable for the preparation of finely divided dispersions.

DISPERSION 2

The procedure is the same as that described for dispersion 1, but using polymer II and coupler Y 5 (dispersion 2a) or coupler Y 8 (dispersion 2b). The resulting dispersions have a dye content of 22.5% (dispersion 2a ) and 20.8% (dispersion 2b). The particle sizes were found to be 156 nm (2a) and 170 nm (2b).

DISPERSION 3

The procedure was that described for dispersion 1. Polymer III and coupler Y 16 were used. The solids content was 20.6%. the particle size 132 nm.

DISPERSION 4

200 g of a 30% solution of polymer IV in a mixture of 90 parts of acetone and 10 parts of water were stirred together with a solution of 15 g of coupler Y 11 (dispersion 4a) or 15 g of coupler Y 13 (dispersion 4b) in 50 g of acetone to form a clear solution. 190 g of water were then added at the rate of 25 g per minute and the acetone was evaporated off under vaccum. The resulting dispersion had a solids content of 27% (dispersion 4a) or 28.5% (dispersion 4b), respectively.

DISPERSION 5

The method was the same as that for dispersion 1, but using color coupler M 2. The dispersion obtained had a solids content of 23.2%.

DISPERSION 6

The method was the same as that for dispersion 4, but using polymer II and color coupler M 1. The solids content of the dispersion was 28%.

DISPERSION 7

100 g of a 15% solution of polymer I in a mixture of 90 parts of tetrahydrofuran and 10 parts of water were stirred together with a solution of 15 g of color coupler C 1 in 62 g of tetrahydrofuran to form a clear solution. 173 g of water were then added at the rate of 15 g per minute and the tetrahydrofuran was removed by dialysis against running water. A 10.2 dispersion was obtained.

DISPERSIONS 8 to 14

For comparison, the color coupler used in dispersions 1 to 7 were dispersed by a conventional method as follows: 30 ml of ethyl acetate and 10 ml of di-n-butylphthalate were added to 10 g of the color coupler. The mixture was dissolved by heating to ca. 45° C. The resulting solution was added to 120 ml of an aqueous solution containing 9 g of gelatine and 0.5 g of sodium-p-dodecylbenzene sulfonate. This mixture was mechanically stirred using a high speed stirrer for 8 minutes so that the coupler together with all the solvent was dispersed in the form of droplets. The ethyl acetate remaining in the droplets was removed at reduced pressure.

DISPERSION 15

A latex was prepared as described in Example 1 of German Offenlegungsschrift No. 2,541,274 and charged with colour coupler Y 6 in the manner described. The proportion, by weight, of color coupler to polymer was 1:1. The particle sizes were 240 nm and 210 nm, respectively.

COMPARISON DISPERSIONS

Dispersions 2, 3 and 4 described in DD Pat. No. 138,831 were used as dispersion A, B and C containing the couplers identified by formulae. The substance used as polymer (VI) was a polyaddition product of 218.5 g of adipic acid-hexane doil-neopentylglycol polyester (OH number 63), 55 g of 1,6 hexane diisocyanate and 27.8 g of sodium 1,2-diaminoethane-N-propane sulfonate.

Dispersion A:

Magenta coupler $A_1$

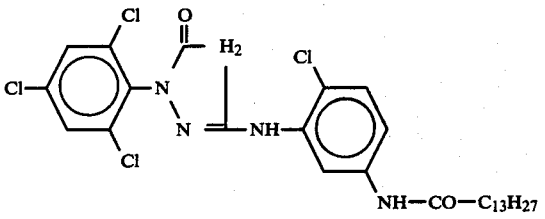

Magenta coupler $A_2$

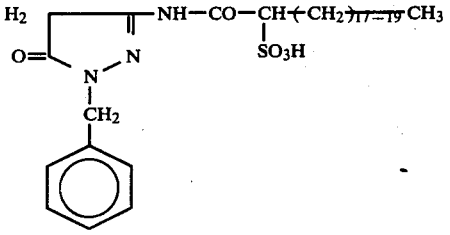

10 g of magenta coupler $A_1$, 2 g of magenta coupler $A_2$ and 5 g of dibutylphthalate were dissolved in 100 ml of a methanolic solution of polymer VI (concentration 20%).

This mixture was stirred into 100 ml of water at 50° C., using a low speed laboratory stirrer, the low boiling organic solvent was removed by vacuum distillation, and the mixture was stabilized using 100 ml of a 5% aqueous gelatine solution.

Dispersion C

Yellow coupler $C_1$

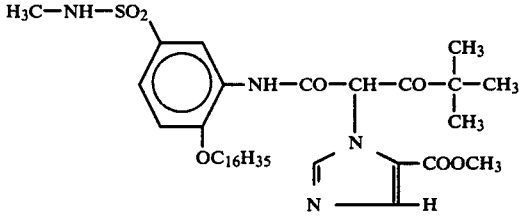

Yellow coupler $C_2$

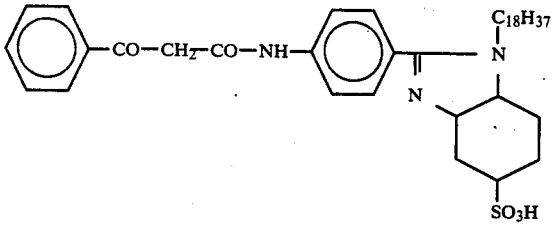

8 g of yellow coupler $C_1$, 1.8 g of yellow coupler $C_2$ and 6 g of dibutyl phthalate were dissolved in 100 ml of a methanolic solution of polymer VI (concentration 20%).

This mixture was stirred into 100 ml of a 5% aqueous gelatine solution (phthaloyl gelatine) at 50° C. The gelatine/polymer/coupler phase was flocculated by adjusting the pH so that the low boiling organic solvent could be removed.

Dispersion B

Cyan coupler $B_1$

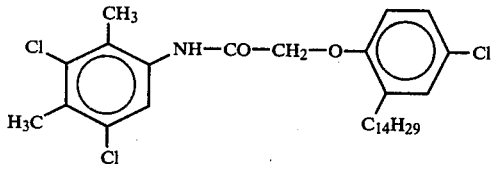

Cyan coupler $B_2$

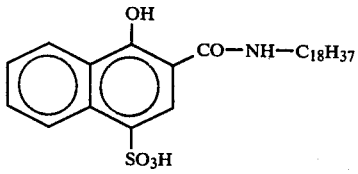

10 g of cyan coupler $B_1$, 2 g of cyan coupler $B_2$ and 5 g of dibutylphthalate were dissolved in 100 ml of an acetonic solution of polymer VI (20% ). This mixture was stirred at 50° C. into 100 ml of water containing 1 g of dissolved color coupler $B_2$. The low boiling organic solvent was removed by distillation.

The dispersions prepared as described above sedimented and the non-sedimenting portions had a particle size of ca. 1 μm. Mixtures of the dispersions with gelatine formed cloudy layers.

COMPARISON DISPERSIONS D, E AND F

Dispersion D 93.75 g of a 32% polyurethane dispersion with a content of 3% sulfonate groups and an average particle size of 75 μm were converted into a solution by adding 201 g of acetone. A solution of 15 g of the coupler Y 5 in 60 g of acetone were added to this. 150 g of water were slowly added dropwise to the resulting clear solution of polyurethane and coupler and then the acetone was evaporated off by means of a rotary evaporator. The resulting polyurethane dispersion containing the colour couplers had a particle size of 19 nm.

Dispersion E

Example A was repeated instead of coupler Y 5 coupler M 2 was used. The resulting dispersion had a particle size of 28 nm.

Dispersion F

Example A was repeated. Instead of coupler Y 5, coupler C 1 was used. The resulting dispersion had a particle size of 34 nm.

EXAMPLE 1

Dispersions 1 to 15 were added to samples of a silver halide gelatine emulsion which had been sensitized for blue, green or red according to the color coupler introduced. The silver halide gelatine emulsion used consisted of 75 g of silver iodobromide (iodide content 3 mol %) and 72 g of gelatine based on 1 kg of emulsion.

The emulsions prepared in this manner were applied to a cellulose triacetate support covered with adhesive layer, and dried.

Photographic test:

The individual samples were exposed by means of a sensitometer and then processed as described below. The factors determined were the relative sensitivity, the color yield and the absorption and side absorption at density 1.0. The results are shown in Table 1 below.

| | |
|---|---|
| Color developer A: | |
| Sodium metaphosphate | 2 g |
| Sodium sulfite anhydrous | 2 g |
| NaOH 10% | 5 ml |
| Soda anhydrous | 50 g |
| Potassium bromide | 1 g |
| N—ethyl-N—(β-methanesulfonamido)-ethyl-4-amino-3-methylaniline sesquisulfate | 5 g |
| Benzyl alcohol | 3 ml |
| Water up to | 1000 ml |
| pH | 10.75 |
| Bleaching bath | |
| Ethylene diaminotetracetic acid | 3 g |
| Potassium hexacyanoferrate | 50 g |
| Potassium bromide | 15 g |
| Disodium hydrogen phosphate | 1 g |
| Potassium dihydrogen phosphate | 19 g |
| Water up to | 1000 ml |
| Fixing bath | |
| Sodium thiosulfate cryst. | 200 g |
| Water up to | 1000 ml |
| Colour developer B: | |
| Nitriloacetic acid | 2 g |
| Sodium sulfite anhydrous | 2 g |
| Hydroxylamine hydrochloride | 1.8 g |
| Potassium bromide | 1.5 g |
| N—ethyl-N—(β-hydroxy)-ethyl 4-amino-3-ethylaniline sulfate | 5 g |
| Sodium hydroxide | 9.5 g |
| Water up to | 1000 ml |
| pH | 10.8 |

| | Development times | |
|---|---|---|
| | Development A (25° C.) | Development B (30° C.) |
| Color development | 12′ | 6.5′ |
| Rinsing | 15′ | 4′ |
| Bleaching bath | 5′ | 4′ |
| Rinsing | 5′ | 4′ |
| Fixing bath | 5′ | 4′ |
| Final rinse | 10′ | 4′ |

TABLE 1

| Dispersion | Development | Relative sensitivity | Gamma | Color yield | Absorption maximum | Side absorption Blue | Yellow | Red |
|---|---|---|---|---|---|---|---|---|
| 1 | A | 77 | 0.50 | 1.52 | 443 | 100 | 3 | 1 |
| | B | 71 | 0.75 | 1.60 | 445 | 100 | 3 | 0 |
| 8 | A | 84 | 0.55 | 1.45 | 443 | 100 | 3 | 1 |
| | B | 79 | 0.66 | 1.37 | 446 | 100 | 3 | 0 |
| 15 | A | 80 | 0.56 | 1.48 | 444 | 100 | 3 | 1 |
| | B | 77 | 0.72 | 1.46 | 445 | 100 | 3 | 0 |
| 4a | A | 87 | 1.90 | 1.45 | 450 | 100 | 4 | 0 |
| | B | 85 | 1.05 | 1.48 | 456 | 100 | 5 | 1 |
| 11a | A | 99 | 1.80 | 1.28 | 450 | 100 | 5 | 1 |
| | B | 94 | 1.16 | 1.38 | 456 | 100 | 4 | 1 |
| 2a | A | 100 | 0.70 | 1.52 | 440 | 100 | 2 | 1 |
| | B | 82 | 0.57 | 1.36 | 446 | 100 | 2 | 0 |
| 9a | A | 97 | 0.81 | 1.38 | 441 | 100 | 2 | 1 |
| | B | 80 | 0.69 | 1.31 | 447 | 100 | 2 | 1 |
| 5 | A | 88 | 1.03 | 2.05 | 555 | 16 | 100 | 11 |
| | B | 91 | 1.30 | 1.62 | 558 | 17 | 100 | 12 |
| 12 | A | 93 | 1.05 | 1.86 | 552 | 17 | 100 | 12 |
| | B | 94 | 1.22 | 1.65 | 557 | 17 | 100 | 12 |
| 7 | A | 72 | 1.75 | 2.39 | 660 | 8 | 18 | 100 |
| | B | 72 | 2.2 | 2.47 | 661 | 9 | 19 | 100 |
| 14 | A | 73 | 1.70 | 2.08 | 658 | 8 | 19 | 100 |
| | B | 75 | 2.0 | 2.38 | 657 | 9 | 19 | 100 |

Footnote:
Sensitivity: A smaller number denotes a higher sensitivity (3 units ≈1 DIN)

As shown in Table 1, the sensitivity of the color photographic layers containing dispersions which have been prepared in accordance with the present invention is up to 4 DIN higher than that of the comparison layers. The color coupler contained in the samples according to the present invention have, with only slight deviations, coupled with steeper gamma. The color yields of the couplers which have been incorporated in accordance with the present invention are substantially higher than those of samples processed by the conventional methods. The color couplers are found to be exceptionally reactive if they have been incorporated by the method according to the present invention. The data relating to the absorption of the dyes are in no way deleteriously affected by the dispersions according to the present invention.

EXAMPLE 2

Dispersions 1, 2*b* and 3 and comparison dispersion 8, 9*b* and 10 were added to a silver halide gelatine emulsion having the composition described in Example 1. When ready for casting, the resulting emulsions were applied to cellulose triacetate supports covered with adhesive layers. Samples of the layers obtained were exposed as described in Example 1, developed as described below and then tested for graininess. Two variations of color development were employed. They differed in the composition of the color developer, which contained citracinic acid in one case, but not in the other. It was found that higher color yields were obtained without citracinic acid. The quotient Q in Table 2 below is obtained from the difference between the color yields obtained when developing with and without citracinic acid, multiplied by $10^2$.

$$Q=(F_{Ao}-F_{Am}/F_{Ao}$$

$F_{Ao}$=color yield from development without citracinic acid $F_{Am}$=color yield from development with citracinic acid.

The samples were processed in the following baths:

| | | |
|---|---|---|
| Black-and white-developer (pH 9.9) | | |
| p-Methylaminophenol sulfate | | 2 g |
| Sodium sulfite | | 42 g |
| Hydroquinone | | 6 g |
| Soda, anhydrous | | 24 g |
| Potassium thiocyanate | | 1.4 g |
| Sodium bromide | | 1.5 g |
| Water | up to | 1000 ml |
| Reversal bath (pH 5.8) | | |
| Propionic acid | | 12 ml |
| Tin-II-chloride | | 1.2 g |
| Sodium salt of ethylene diaminotetracetic acid | | 1 g |
| p-Aminophenol | | 0.5 mg |
| Sodium hydroxide solution | | 4.8 g |
| Water | up to | 1000 ml |
| Color developer | | |
| Water | | 800 ml |
| Sodium salt of ethylene diaminotetracetic acid | | 1 g |
| Phosphoric acid | | 6.9 g |
| Sodium bromide | | 0.65 g |
| Potassium iodide | | 30 mg |
| Potassium hydroxide solution, 10% | | 31 ml |
| Sodium sulfite anhydrous | | 4.5 g |
| Citracinic acid | | 1.25 g |
| Ethylene-dithio-diethanol-4-amino-3-methyl-N—ethyl-N—β-methanesulfonamino)-ethyl anline-sesquisulfate | | 11.0 g |
| Bleaching bath (pH 5.7) | | |
| Water | | 600 ml |
| Potassium nitrate | | 25 g |
| Potassium bromide | | 78 g |
| Hydrobromic acid, 48% | | 25 ml |
| Trilon B | | 4 g |
| Ethylene diaminotetracetic acid-sodium-iron-3-salt | | 100 g |
| Adjusted to pH 5.7 using 25% ammonium hydroxide | | |
| Fixing bath (pH 6.6) | | |
| Ammonium thiosulfate | | 65 g |
| Sodium salt of ethylene diaminotetracetic acid | | 0.94 g |
| Sodium dithionite | | 9.3 g |
| Sodium hydroxide | | 2 g |
| Water | up to | 1000 ml |
| Processing times | | |
| 1. Black-and-white developer | | 3.5' |
| 2. Reversal bath | | 3' |
| 3. Washing | | 3' |

-continued

| | |
|---|---|
| 4. Color development | 10' |
| 5. Washing | 5' |
| 6. Bleaching bath | 10' |
| 7. Washing | 2' |
| 8. Fixing bath | 5' |
| 9. Washing | 10' |

TABLE 2

| Dispersion | Color density D = | Graininess 0.5 | 1.0 | 1.5 | Q |
|---|---|---|---|---|---|
| 1 | | 2.0 | 1.9 | 1.6 | 12.3 |
| 2b | | 2.2 | 3.2 | 4.0 | 9.1 |
| 3 | | 2.8 | 3.0 | 3.2 | 4.8 |
| 8 | | 2.3 | 2.0 | 1.8 | 16.7 |
| 9b | | 2.5 | 4.5 | 5.5 | 10.7 |
| 10 | | 3.0 | 3.3 | 3.3 | 7.4 |

D = color density

Table 2 shows the excellent fineness of grain of samples 1, 2*b* and 3 according to the present invention compared with the corresponding comparison samples 8, 9*b* and 10. Quotient Q whose absolute value is proportional to the influence of citracinic acid was also found to be substantially lower in the samples according to the present invention. This is connected with the high reactivity of color couplers dispersed according to the present invention, which has been mentioned above.

EXAMPLE 3

Dispersions 1, 2*a*, 6, 7 and 15 according to the present invention and comparison dispersions 8, 9*a*, 13 and 14 were mixed with the silver halide gelatine emulsions which were sensitized according to the couplers, and the emulsions obtained were cast on a baryta paper support. The samples were then exposed as described in Example 1 and processed in the baths described below.

| | | |
|---|---|---|
| Color developer | | |
| Water | | 800 ml |
| Hydroxylamine hydrochloride | | 3.5 g |
| Sodium sulfite | | 2.0 g |
| Potassium bromide | | 0.6 g |
| Potassium hydroxide, 85% | | 1.0 g |
| Potash, anhydrous | | 30 g |
| Benzyl alcohol | | 20 ml |
| 4-amino-3-methyl-N—ethyl-N—β-methanesulfonamidoethyl-aniline sesquisulfate | | 6.0 g |
| Water | up to | 1000 ml |
| Short stop bath | | |
| Water | | 800 ml |
| Sodium acetate | | 40 g |
| Glacial acetic acid | | 20 ml |
| Water | up to | 1000 ml |
| Bleach fixing bath (pH 7) | | |
| Ethylene diaminotetracetic acid | | 45 g |
| Sodium sulfite | | 8 g |
| Sodium thiosulphate | | 100 g |
| Sodium carbonate, anhydrous | | 2 g |
| Processing times (25° C.) | | |
| Colour developer | | 8' |
| Short stop bath | | 1' |
| Washing | | 5' |
| Bleach fixing bath | | 4' |
| Washing | | 5' |

The samples, with and without protection against UV light (UV protective foil containing a hydroxybenzotriazole as absorbent substance), were exposed as follows to the light of a Xenon lamp which was standardised for daylight:

| | |
|---|---|
| Samples containing yellow and magenta couplers | 7.2. $10^6$ Lux.H |
| Samples containing cyan coupler | 9.6. $10^6$ Lux.h |

The results are entered in Table 3.

TABLE 3

| Dispersions D = | % Density loss without UV protection 0.5 | 1.0 | $D_{max}$ | % Density loss without UV protection 0.5 | 1.0 | $D_{max}$ |
|---|---|---|---|---|---|---|
| 1 | 34 | 20 | 14 | 19 | 10 | 4 |
| 8 | 76 | 49 | 31 | 62 | 37 | 30 |
| 2a | 15 | 49 | 5 | 12 | 7 | 2 |
| 9a | 48 | 34 | 40 | 23 | 15 | 10 |
| 6 | 40 | 42 | 29 | 28 | 17 | 24 |
| 13 | ca. 80% yellowing: | | | 42 | 39 | 47 |
| 7 | 31 | 19 | 22 | 17 | 12 | 12 |
| 14 | 40 | 34 | 33 | 24 | 16 | 15 |
| 15 | 72 | 55 | 45 | 58 | 38 | 27 |

For comparison, samples of the dispersions described above which were free from coupler were applied to a baryta paper support and exposed as described. None of the samples (with the exception of sample 13) showed any measurable yellowing. It follows from this that the surprising light stabilizing effect of the samples according to the present invention shown in Table 3 is by no means due to a filter effect which would have to be taken into account in the event of any yellowing of the test material.

EXAMPLES 4 TO 7

The following Examples demonstrate the effect of the dispersions according to the present invention on the breaking strength of photographic materials.

A photographic emulsion layer consisting of a silver bromide emulsion, a dispersion prepared according to the present invention or a comparison emulsion, gelatine and a hardener was applied to a prepared cellulose triacetate film support and dried. After drying, the layer contained 20 vol.-% of AgBr and 30 vol.-% of dispersion according to the present invention or comparison emulsion. Strips of this material 36 mm in width were exposed to an atmosphere of 20% relative humidity at 23° C. for 3 days. The measurements were carried out by the falling hammer method in this atmosphere. The samples were arranged in loops with the emulsion layer facing outwards, and the energy required to break the film was measured. Approximately 100 breaking tests, at least half of which should result in breakage, were carried out.

The breaking energy values B measured on layers containing the dispersion according to the present invention were compared with the breaking energy values obtained using comparison emulsions. The increase in breaking strength of the layers containing the dispersions according to the present invention was calculated in % according to the following formula:

$$\Delta B = \frac{B \text{ of dispersion according to the present invention} - B \text{ of comparison emulsion}}{B \text{ of comparison emulsion}} \; 100$$

The results are summarised in the Table below.

TABLE

| Dispersion according to the present invention | Comparison emulsion | Improvement in breaking strength B |
|---|---|---|
| 1 | 8 | 56% |
| 2 a | 9 a | 45% |
| 4 a | 11 a | 38% |
| 7 | 14 | 52% |

We claim:

1. Process for the preparation of dispersions of hydrophobic substances in water by charging an ionically modified polymer with the hydrophobic substance, characterised in that the hydrophobic substance together with an ionomeric polyaddition or condensation product is dissolved in an organic, water-miscible solvent having a boiling point below 120° C. or in a mixture of the organic solvent with water in proportions, by weight, of from 50:50 to 100:0, water is added to the solution so that the proportion, by weight, of solvent to water in the mixture is 10:1 to 1:10, and the organic solvent is then removed.

2. Process according to claim 1, characterised in that the ionomeric polyaddition or condensation product contains from 4 to 180 milliequivalents per 100 g of ionic groups or of groups capable of conversion into ionic groups and/or from 1 to 20%, by weight, of alkylene oxide units of the formula: $CH_2$—$CH_2$—O built into a polyether chain, which polyether chain may be contained in a side chain or in the main chain.

3. Process according to claims 1 or 2, characterised in that the hydrophobic substance and ionomeric polyaddition or condensation product are used in proportions, by weight, of from 1:20 to 1:1.

4. Process according to claims 1 or 2, characterised in that the organic solvent is removed by distillation.

5. Process according to claims 1 or 2, characterised in that the hydrophobic substance used is a photographic color coupler.

6. The method of preparing color photographic materials which comprises the steps of preparing a solution of a hydrophobic substance together with an ionomeric polyaddition or condensation product in an organic, water-miscible solvent having a boiling point below 120° C., or in a mixture of the organic solvent with water in a proportion by weight of from 50:50 to 100:0, water being added to the solution so that the proportion, by weight, of solvent to water in the mixture is from 10:1 to 1:10, and then removing the organic solvent from the solution.

7. Process for the preparation of dispersion as claimed in claim 1 wherein the hydrophobic substance with the ionomeric product is dissolved to form a clear solution.

* * * * *